United States Patent [19]

Egli

[11] 4,265,072

[45] May 5, 1981

[54] APPARATUS FOR CHARGING RECEPTACLES WITH ITEMS OF LIKE SIZE AND SHAPE

[76] Inventor: Alwin Egli, Neuweg 15, CH-8222 Beringen, Switzerland

[21] Appl. No.: 59,021

[22] Filed: Jul. 19, 1979

[30] Foreign Application Priority Data

Jul. 21, 1978 [CH] Switzerland ..... 7914/78

[51] Int. Cl.[3] ..... B65B 57/20; B65B 35/56; B65G 47/24

[52] U.S. Cl. ..... 53/501; 53/532; 53/544; 53/240; 198/406; 198/390; 198/417; 221/173; 221/172; 193/46

[58] Field of Search ..... 53/501, 531, 532, 544, 53/237, 240, 244, 250; 414/780, DIG. 901; 198/406, 417, 418, 532; 221/171, 172, 173

[56] References Cited

U.S. PATENT DOCUMENTS

| | | | |
|---|---|---|---|
| 2,656,962 | 10/1953 | Daniels | 198/406 X |
| 2,866,577 | 12/1958 | Dimond | 221/173 |
| 3,530,639 | 9/1970 | Bross | 53/501 |

FOREIGN PATENT DOCUMENTS 382641 12/1964 Switzerland .

*Primary Examiner*—Travis S. McGehee

[57] ABSTRACT

An apparatus for charging tall, narrow receptacles with small, plate-like items of like size and shape. The apparatus has at least one counting and charging unit having a plurality of axially aligned counting wheels having a plurality of pockets along their periphery for receiving individual items and a funnel arranged underneath the counting wheels for receiving items discharged by the counting wheels and for directing them into a receptacle arranged below the funnel. There are further provided a plurality of orienting channels arranged between the funnel and each counting wheel. Each orienting channel is arranged to receive items from the associated counting wheel and to orient the items such that upon discharge of each item from the orienting channels into the funnel, the main plane of each item is parallel to the main plane of the receptacle situated underneath the funnel. Further, a blocking arrangement cooperates with each orienting channel for periodically opening and closing the orienting channels to permit a simultaneous discharge of two items at the most from the orienting channels into the funnel.

13 Claims, 5 Drawing Figures

APPARATUS FOR CHARGING RECEPTACLES WITH ITEMS OF LIKE SIZE AND SHAPE

BACKGROUND OF THE INVENTION

This invention relates to an apparatus which charges receptacles with items of like dimensions and configuration and which has at least one counting and charging unit comprising a plurality of coaxial toothed counting wheels. The latter receive the items in the tooth gaps and advance the items to a funnel from which they fall into the receptacle.

An apparatus of the above-outlined type is known and is disclosed, for example, in Swiss Pat. No. 382,641. The known arrangements are adapted to handle items which in all the dimensional directions are approximately of the same size, while they may be of asymmetrical shape. These known apparatuses, however, are not adapted to charge narrow and tall receptacles with small plate-like items of rectangular cross section because the items fall at random into the receptacle and there require a substantial space. This is so because the items are not properly aligned in the receptacle and thus there are significant dead spaces between the items. It is another disadvantage of the known arrangements that the items may jam against one another in the funnel and thus clog the same.

SUMMARY OF THE INVENTION

It is an object of the invention to provide an improved apparatus of the above-outlined type from which the discussed disadvantages are eliminated.

This object and others to become apparent as the specification progresses, are accomplished by the invention, according to which, briefly stated, downstream of each counting wheel there is provided an orienting channel which turns the item introduced thereinto in such a manner that the main plane of the item is aligned with the main plane of the receptacle situation underneath the funnel and further, there are provided blocking devices which close the orienting channels and then reopen them to ensure that simultaneously not more than two items can be introduced into the funnel.

By virtue of the fact that in the orienting channels the main plane of the items is turned into alignment with the main plane of the receptacle, the items, as they fall into the receptacle, are, by themselves, stacked into uniform, practically gapless, juxtapositioned layers. Since, at any time, only one, or at the most two, outlets of the orienting channels are simultaneously maintained open by the blocking devices, the items cannot jam against one another in the funnel. It has been found that in this manner, for example, triangular plates of a thickness of approximately 7 mm and a triangle height of 18 mm can be packaged in narrow, tall receptacles into which the items could not otherwise be introduced mechanically. Such a packaging can be effected with a very high output (for example, 100 packages per minute).

DESCRIPTION OF THE PREFERRED EMBODIMENT

Figures 1, 3:
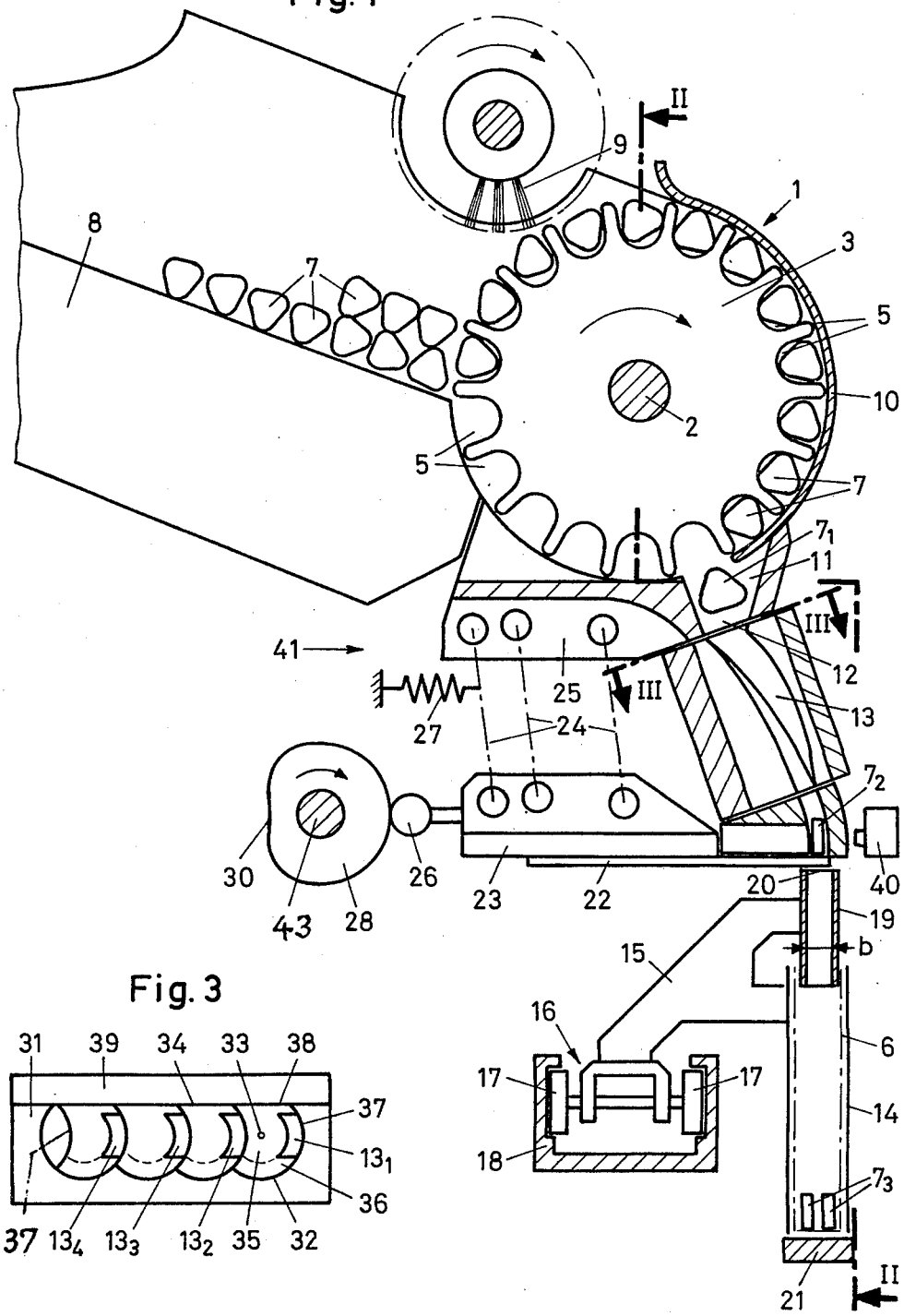
FIG. 1 is a sectional elevational view of a preferred embodiment of the invention.
FIG. 3 is a view taken on line III—III of FIG. 1.
Figure 2:
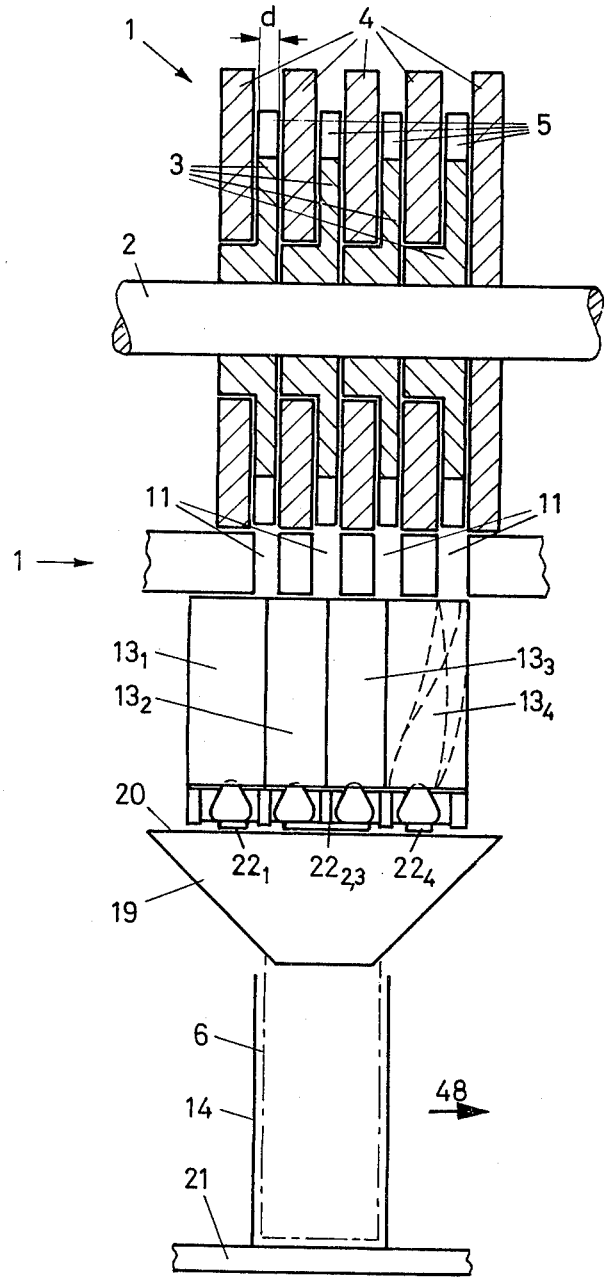
FIG. 2 is a sectional view of some of the components taken along line II—II of FIG. 1.

Turning now to FIGS. 1, 2 and 3, the counting and charging unit illustrated therein comprises a counter 1 which has four counting wheels 3 each mounted on a common horizontal shaft 2 and each arranged between associated guide walls 4. Each counting wheel 3 has a toothed periphery with eighteen tooth gaps 5 which serve for receiving items, such as candies 7 to be introduced in counted quantities into a receptacle 6. The items 7 are small plate-like articles of approximately triangular outline, whose thickness is significantly less than their dimension in the direction of their plane (for example, the height of the triangle). The items 7 are loaded into a hopper (not shown) and are distributed in a known manner on four vibrating chutes 8 which lead to the respective counting wheels 3. Such a counter is described in more detail in the above-noted Swiss Pat. No. 382,641.

The counter 1 further has a rotary brush 9 which throws back those items onto the respective chute 8 which may have adhered to the items already received in the tooth gaps (pockets) 5. A shroud 10 surrounding one part of the counting wheels 3 retains the items 7 in the tooth gaps 5 until they can fall into respective outlet channels 11 which, at 12, change into respective orienting channels 13. In each orienting channel 13 the item 7 is turned 90° from the position $7_1$ to the position $7_2$, so that in the reoriented position $7_2$ the main item plane is in alignment with the main plane of the receptacle 6, that is, the main item plane is perpendicular to the drawing plane of FIG. 1. It is noted that by main plane of the receptacle, there is meant a plane which is parallel to the height of the receptacle and the long sides of the receptacle opening.

The receptacle 6 is positioned within a conveyor vessel 14 which is secured to a carrier member 15 of a conveyor chain 16 which, in turn, is guided with rollers 17 in a guide track 18. To the carrier member 15 there is further secured a funnel 19 whose inlet opening 20 is longer in the direction of forward motion 48 of the conveyor chain 16 than the long side of the opening of the receptacle 6. A vibrating bottom 21 is arranged underneath the conveyor vessel 14. The conveyor vessel 14 is bottomless so that the empty receptacle can be inserted from below and the filled receptacle can be removed downwardly. Details of the chain and conveyor vessel structure are not shown, since these are conventional arrangements.

The item $7_2$ cannot immediately fall into the funnel 19 and thus into the receptacle 6, bacause it is first retained by a slide gate 22. The latter is secured to a holder 23 which is suspended by connecting rods 24 from a housing portion 25 and which is provided with a follower head 26. A tension spring 27 continuously urges the follower head 26 against the periphery of a rotating control cam 28 which, in turn, is secured to a shaft 43. It is seen that when the follower head 26 assumes a position in the bay-like portion 30 of the cam 28, the slide gate 22 opens and allows the item $7_2$ to fall into the funnel 19.

In order to prevent items 7 from jamming against one another in the funnel 19, it is important that simultaneously not all four items situated in position $7_2$ be released. While a separate slide gate 22 could be associated with each orienting channel 13, it has been found that it is sufficient to provide the two outermost orienting channels $13_1$ and $13_4$ with their own slide gate $22_1$ and $22_4$, while the two inner orienting channels $13_2$ and $13_3$ are provided with a common slide gate $22_{2,3}$. FIG. 1 shows at $7_3$ that the items 7 assume, by themselves, a uniform, stacked, multilayered, juxtapositioned relationship. It is noted that the distance between the items is shown significantly magnified for better visibility. The articles 7 which fall into the receptacle 6 individually or pairwise may, however, be arranged in a single layer which would be the case in very narrow receptacles. The width of the receptacle need to be only very slightly greater than the dimension b of the funnel 19. The length b, in turn, is approximately equal to the thickness d of the counting wheels 3. Further, the thickness of the articles to be introduced into the receptacle need to be exceeded only slightly by the dimension d.

In the description which follows the structure and the making of the orienting channels 13 will be described.

In a rectangular block 31 (as shown in FIG. 3) four overlapping circular bores 32 are provided. The center of the rightmost bore 32 is designated at 33. The bores further intersect a lateral surface 34 of the block 31. Into the bores 32 there are inserted four cylindrical cores 35, each having a helical groove 36 along its outer face, an axially parallel groove 37 which corresponds to the bore profile as well as a planar cut portion 38 which is flush with the lateral surface 34. Thereafter, a plate 39 is positioned on the lateral face 34 and is connected with the block 31 and the cores 35, for example, by gluing or by screw connection.

During operation, in order to verify whether in fact from each tooth gap 5 an item 7 has fallen into the position $7_2$, at the lower end of each orienting channel 13 there is arranged a sensor, such as a light barrier 40 which, in a known manner, directs a light beam onto the item $7_2$ and which responds to the light reflected thereby. The sensor 40 preferably operates with infrared light. The sensor 40 transmits an "item present" signal in case an item 7 is situated in the position $7_2$ and emits an "item absent" signal if no item is present. It is to be understood that the absence of an "item present" signal itself may be the "item absent" signal.

Figure 4:
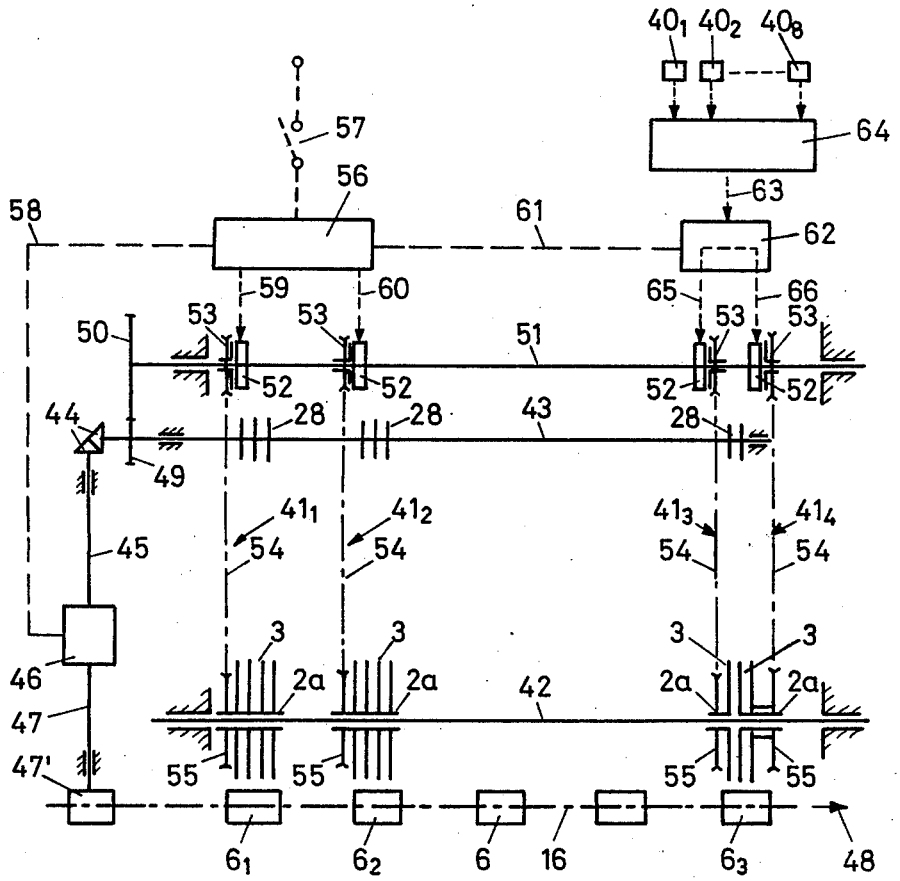
FIG. 4 is a diagrammatic view of the invention including a charging device having four counting and charging units.

Turning now to FIG. 4, by way of example, the operation of the apparatus according to the invention, having four counting and charging units $41_1$, $41_2$, $41_3$ and $41_4$ will be described. It is noted that two units, namely units $41_1$ and $41_2$ each have four counting wheels 3 similarly to the unit described in connection with FIGS. 1–3, while the units $41_3$ and $41_4$ have only one and, respectively, two counting wheels 3. The units $41_3$ and $41_4$ are operating only in case the light barrier 40 of the unit $41_1$ and/or $41_2$ reports the missing of articles and therefore the units $41_3$ and $41_4$ are designated as standby or correcting units. In case there is not required a high precision regarding the number of articles per receptacle to be packed, the light barriers 40 and the correcting units $41_3$ and $41_4$ may be omitted together with their control devices to be described in more detail later.

The shafts of the units $41_1$–$41_4$ are—departing from the structure shown in FIGS. 1 and 2—hollow shafts 2a arranged on a common axle 42 which is supported in the machine frame at its ends. The control cams 28 of the units are affixed to a common shaft 43 which is driven by a shaft 45 via bevel gears 44. For driving the shaft 45 there is provided an electric motor 46 which, via a further shaft 47 and a drive 47' also drives, continuously or stepwise, the endless conveyor chain 16. The upper reach of the chain 16 carries the receptacles 6 in the direction of the arrow 48. On the shaft 43 there is mounted a spur gear 49 which drives a shaft 51 by meshing with a larger spur gear 50 mounted on the shaft 51. On the shaft 51 there are further mounted four electrically operated jaw-type clutches 52 which serve for coupling the shaft 51 to sprockets 53. The sprockets 53 drive the hollow shafts 2a via chains 54 and larger sprockets 55.

A first electric control device 56 is coupled to a line voltage with the intermediary of a manual switch 57. When the switch 57 is closed, the motor 46 is energized by current supplied thereto by a conductor 58. Further, by means of a conductor 59, the clutch 52 connected thereto is actuated, so that the counting wheels 3 of the first unit $41_1$ rotate and, with the advance of every tooth division, drop one item 7 into the outlet channels 11 from which the items pass into the respective orienting channels 13. The blocking devices 22 are successively actuated by the control cams 28 so that from each counting wheel successively an item 7 is advanced into the receptacle 6 situated in position $6_1$. The speed of the conveyor chain 16, which may be operated continuously or intermittently, is coordinated with the speed of the shafts 43 and 51 and with the control device 56 in such a manner that the control device 56 actuates, via a conductor 60, the clutch 52 associated with the unit $41_2$ only when the receptacle 6 situated in position $6_2$ is ready to be charged by the unit $41_2$. It is feasible to provide additional units 41, each delivering four items into the receptacle 6, in which case the four items correspond to the number of counting wheels 3 per unit.

From the control device 56 a conductor 61 leads to a second control device 62 which is connected, by means of a conductor 63 with a third control device 64 which, in turn, is connected with light barriers $40_1$, $40_2$, . . . , $40_8$, one associated with each counting wheels 3 of the units $41_1$ and $41_2$. The control device 62 is further connected, by means of respective conductors 65 and 66, with the clutches 52 associated with the correcting units $41_3$ and $41_4$. The control device 64 is an adder for summing the "item absent" signals. The control device 64 is provided for setting the desired quantity of items per receptacle. As a receptacle leaves the position $6_2$ and is advanced towards the position $6_3$, the control device 64 determines whether the number of pulses in the adder (corresponding to the quantity of items deposited in the receptacle 6) has reached the desired quantity preset in the control device 64. Should this not be the case, the control device 64, by means of the conductor 63, sets the control device 62 in operation. The control device 62, in turn, actuates the correcting units $41_3$ or $41_4$ by means of respective conductors 65 and 66 whereby upon rotation of the counting wheels 3 of the unit $41_3$ or $41_4$ through each tooth division, one or, respectively, two items are fed into the receptacle 6 when it is situated in the position $6_3$, until the desired preset quantity of items is reached.

Reference numeral 47' denotes a stepwise moving drive, such as, for example, a Geneva-gear transmission. This means that the chain 16 with receptacle 6 is moving stepwise. Shortly before the end of the chain movement, switches $6_1'$, $6_2'$ and $6_3'$ (FIG. 5) arranged at positions denoted by receptacles 6 and $6_2$ (FIG. 4) are operated by the respective receptacles 6. Thereby clutches 52 are operated in dependence of control devices 56, 62, 64. For example, a cam switch 57' operated by shaft 43 opens and closes once each operational period. Switches $6_1'$, $6_2'$ and 57' form the control device 56 of FIG. 4.

The adjustment of movement of the chain 16 and the shafts 43 and 51 may be achieved in a usual manner by gears 44, 49, 50, 53 and 55. During one complete revolution of the shaft 47, one receptacle 6 is moved from position $6_1$ to position $6_2$ by means of the maltese-cross (Geneva-gear) transmission 47' and chain 16 at which position the receptacle is stopped shortly. The further shaft 45 together with shaft 43 and cam 28 turns at the same time for one complete revolution for opening each slide gate 22 once for each operation period.

The speed reduction by means of gears 49, 50 and sprocket wheels 53, 54 assures that for each complete revolution of shaft 45 the gears 3 move forward by only one tooth pitch.

As shown in FIG. 4 the receptacles may have, in position $6_3$, no items at all or may have one or two items. This is dependent of the control devices 62, 64 which either do not operate clutches 52 for the charging units $41_3$ and $41_4$, or operate the clutches either for unit $41_3$ or $41_4$ alone. Near the charging units $41_3$ this embodiment discloses no light barriers 40.

Figure 5:
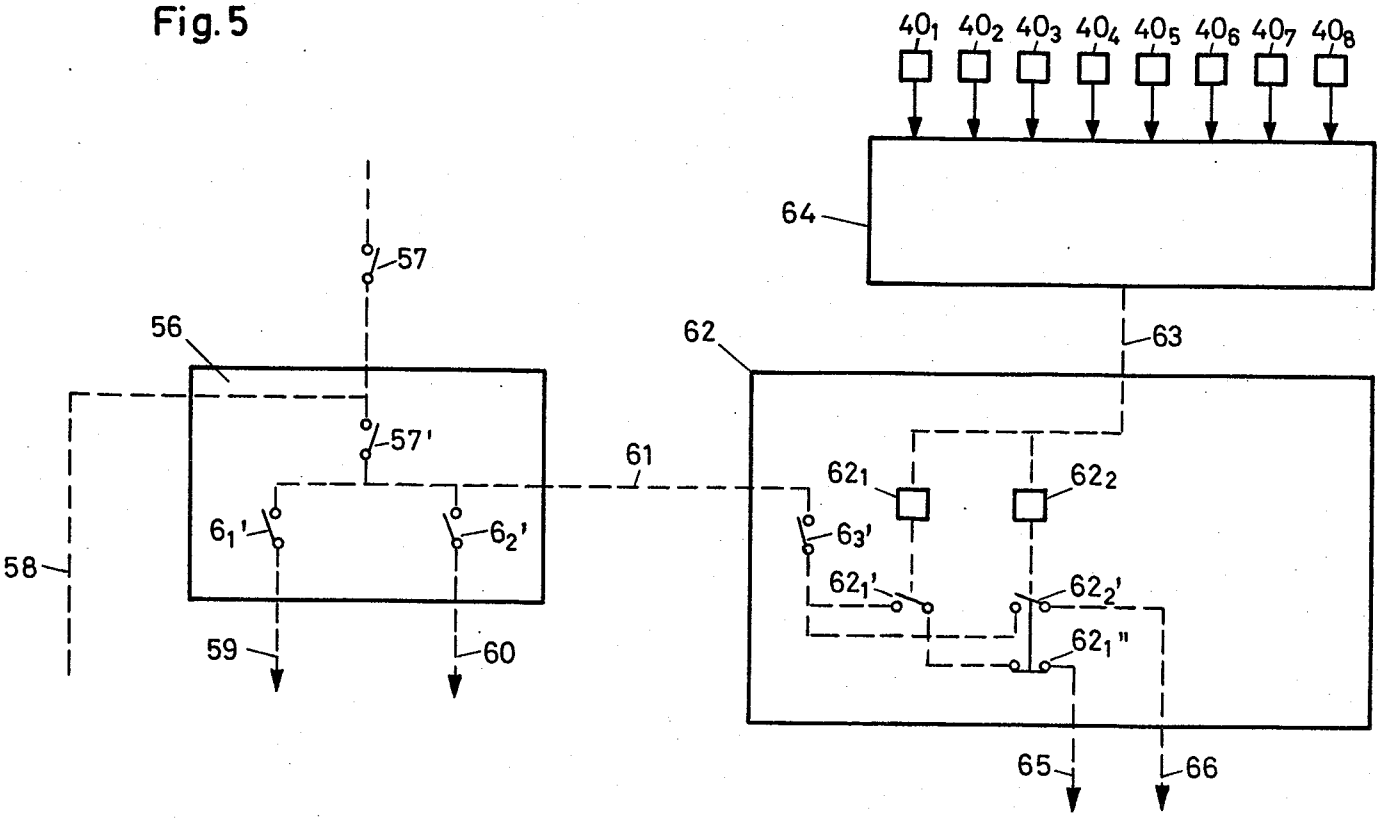
FIG. 5 is a block diagram of the control units of FIG. 4.

The control devices 56, 62, 64 are shown diagrammatically in FIG. 5. The control device 64 is, for example, a pulse generator for interpreting the error signals $5_1$ supplied by the sensor 40 during one cycle of operation and for generating a DC signal $5_1'$ whose the voltage is proportional to the received pulses $5_1$. The DC signal $5_1$ is applied to two threshold units $62_1$ and $62_2$. At the occurrence of only one error signal the threshold unit $62_1$, only closes contact $62_1'$ at the occurrence of two error signals the threshold unit $62_2$ also closes contact $62_2'$ and opens contact $62_1'$. Thereby the charging unit $41_3$ is operated via line 65 to charge one item respectively and when two items should be charged, the charging unit $41_4$ is operated by means of line 66.

It is to be understood that the above description of the present invention is susceptible to various modifications, changes and adaptations, and the same are intended to be comprehended within the meaning and range of equivalents of the appended claims.

What is claimed is:

1. In an apparatus for charging receptacles with items of like size and shape, including at least one counting and charging unit having a plurality of axially aligned, toothed counting wheels having a plurality of tooth gaps along their periphery for receiving individual items; and a funnel arranged underneath the counting wheels for receiving items discharged by the counting wheels and for directing them into a receptacle arranged below the funnel; the improvement comprising (a) means defining a plurality of orienting channels, a separate one of said orienting channels being arranged between said funnel and each said counting wheel; each said orienting channel receiving items in sequence from the associated counting wheel; the items being of plate-like configuration having a main plane parallel to the opposite, relatively large item faces; the receptacles having a narrow opening with relatively long and relatively short sides and a main plane being parallel to the height dimension of the receptacle and to the long sides of the receptacle opening; each said orienting channel being further arranged to orient the items such that upon discharge of each item from the orienting channels into said funnel, the main plane of each item is parallel to the main plane of the receptacle situated underneath said funnel;

(b) blocking means cooperating with each said orienting channel for periodically opening and closing the orienting channels; and (c) means controlling said blocking means for permitting a simultaneous discharge of two items at the most from said orienting channels into said funnel.

2. An apparatus as defined in claim 1, wherein the axially measured thickness of each said counting wheel is approximately of the same magnitude as the smallest cross-sectional dimension of the funnel.

3. An apparatus as defined in claim 1, wherein said means defining a plurality of orienting channels comprises (a) a block member;

(b) a plurality of parallel, overlapping bores provided in said block member;

(c) a cylindrical core positioned in each said bore coaxially therewith; each said core having (1) an axially parallel groove of concave cylindrical base complemental to the shape of an adjoining said core for receiving a length portion thereof, whereby said cores are longitudinally nesting in one another and (2) a helical groove extending along the length of the core and having dimensions for receiving the items in a predetermined orientation.

4. An apparatus as defined in claim 1, wherein said blocking means comprises a plurality of slide gates each cooperating with at least one of said orienting channels and further wherein said means controlling said blocking means comprises a plurality of rotary cams, one associated with each slide gate; a follower affixed to each slide gate and being in engagement with a respective said cam; and means for driving said cams for reciprocating said slide gates for opening and closing the orienting channels associated therewith.

5. An apparatus as defined in claim 4, wherein said unit has four counting wheels and three parallel, side-by-side arranged said slide gates; and further wherein the center slide gate is associated with two orienting channels and the other two slide gates are associated with two separate said orienting channels.

6. An apparatus as defined in claim 4, wherein said cams are arranged on a common shaft.

7. An apparatus as defined in claim 1, wherein there are provided at least two counting and charging units each having at least four said counting wheels.

8. An apparatus as defined in claim 7, wherein there is provided at least one correcting counting and charging unit having at least one said counting wheel; further comprising a sensor associated with each said orienting channels of said at least two counting and charging units; a control device connected to each sensor and to said correcting counting and charging unit; each said sensor being arranged to apply to said control device a signal each time an item passes through the respective said orienting channel; said control device including means for actuating said correcting counting and charging unit upon determining a deficiency of the quantity of items deposited in the receptacle by said at least two counting and charging units in the receptacle as compared to a quantity preset in said control device, whereby said correcting counting and charging unit supplies the deficient quantity of items to said receptacle.

9. An apparatus as defined in claim 8, wherein there are provided two correcting counting and charging units; one of said counting and charging units having a single said counting wheel and the other having two said counting wheels.

10. An apparatus as defined in claim 1, wherein there are provided a plurality of counting and charging units; further comprising drive means for rotating said counting wheels of each said unit; a separate clutch associated with each unit for operatively coupling the counting wheels of the respective unit to and disconnecting them from said drive means; and electric control means connected to each said clutch for individually operating said units.

11. An apparatus as defined in claim 10, wherein said clutches are arranged on a common shaft.

12. An apparatus as defined in claim 11, wherein the counting wheels of each unit are mounted on axially aligned hollow shafts driven by said drive means; further comprising a common axle on which all said hollow shafts are mounted.

13. In an apparatus for charging receptacles with flat items of like size and shape; at least one counting and charging unit having a plurality of axially aligned counting wheels having a plurality of pockets along their periphery for receiving individual items; and a funnel arranged underneath the counting wheels for receiving items discharged by the counting wheels and for directing them into a receptacle arranged below the funnel; the improvement comprising (a) means defining a plurality of orienting channels each having an inlet and an outlet; a separate one of said orienting channels being arranged between an inlet opening of said funnel and each said counting wheel for receiving items from the associated counting wheel; said orienting channels having a flat cross-sectional area generally corresponding to the cross-sectional area of the items for determining the position of the items as they advance therein by gravity; said outlets of said orienting channels being arranged in a longitudinal, end-to-end alignment along said inlet opening of said funnel, whereby all items are introduced from the several orienting channels into said funnel in identical orientations;

(b) blocking means cooperating with each said orienting channel for periodically opening and closing the orienting channels; and (c) means controlling said blocking means for permitting a simultaneous discharge of two items at the most from said orienting channels into said funnel.

* * * * *

UNITED STATES PATENT AND TRADEMARK OFFICE

CERTIFICATE OF CORRECTION

PATENT NO. : 4,265,072

DATED : May 5, 1981

INVENTOR(S) : Alwin Egli

It is certified that error appears in the above—identified patent and that said Letters Patent is hereby corrected as shown below:

In the heading of the patent, add --[73] Assignee: SIG - Schweizerische Industrie-Gesellschaft, Neuhausen am Rheinfall, Switzerland--

Column 1, line 41, change "situation" to --situated--.

Column 2, line 58, change "bacause" to --because--.

Column 5, line 35, change "$5_1$" to --$5_1$'--.

Signed and Sealed this

Sixth Day of October 1981

[SEAL]

*Attest:*

GERALD J. MOSSINGHOFF

*Attesting Officer*

*Commissioner of Patents and Trademarks*